US012364899B2

(12) United States Patent
Dickerson

(10) Patent No.: US 12,364,899 B2
(45) Date of Patent: Jul. 22, 2025

(54) PUSHUP AND PLANKING EXERCISE DEVICE

(71) Applicant: Todd Evan Dickerson, Phoenix, TX (US)

(72) Inventor: Todd Evan Dickerson, Phoenix, TX (US)

( * ) Notice: Subject to any disclaimer, the term of this patent is extended or adjusted under 35 U.S.C. 154(b) by 168 days.

(21) Appl. No.: 18/186,916

(22) Filed: Mar. 20, 2023

(65) Prior Publication Data

US 2023/0293935 A1 Sep. 21, 2023

Related U.S. Application Data

(60) Provisional application No. 63/321,492, filed on Mar. 18, 2022.

(51) Int. Cl.
*A63B 21/00* (2006.01)
*A63B 23/12* (2006.01)

(52) U.S. Cl.
CPC ..... *A63B 21/4029* (2015.10); *A63B 23/1236* (2013.01); *A63B 2225/093* (2013.01)

(58) Field of Classification Search
CPC ..... A63B 21/068; A63B 21/4029; A63B 21/4033; A63B 21/4047; A63B 23/1236; A63B 26/00; A63B 26/003
See application file for complete search history.

(56) References Cited

U.S. PATENT DOCUMENTS 5,755,651 A 5/1998 Homyonfer et al.
6,702,726 B2 3/2004 Lin
6,994,661 B1 2/2006 Dawson
7,780,586 B2 * 8/2010 Gates ..... A63B 26/00 482/142
7,803,096 B2 9/2010 Mehta
7,942,795 B2 5/2011 Harris
7,951,056 B2 5/2011 Radzwill
10,363,449 B2 7/2019 Scott et al.
2002/0187886 A1 12/2002 Wu
(Continued)

FOREIGN PATENT DOCUMENTS

CA 2280303 2/2001
CN 203183593 9/2013
(Continued)

OTHER PUBLICATIONS

International Search Report issued by the U.S. Patent and Trademark Office as the International Searching Authority for International PCT Application No. PCT/US23/15706, mailed Jun. 27, 2023, 10 pages.

*Primary Examiner* — Megan Anderson
(74) *Attorney, Agent, or Firm* — SPRINKLE IP LAW GROUP

(57) ABSTRACT

An apparatus for assisting pushups or planks comprising a base structure having a substrate contact surface and a flat padded bench rotatably coupled to the base structure. The flat padded bench has rectangular shape adapted to support the user and not interfere with the user's shoulders when performing a pushup or plank. The flat padded bench is rotatable relative the base structure about an axis of rotation from a neutral position to a first fully rotated position and a second fully rotated position. The height of the device is selected to allow users to perform pushups or planks.

22 Claims, 7 Drawing Sheets

(56) References Cited

U.S. PATENT DOCUMENTS

| | | | | |
|---|---|---|---|---|
| 2007/0298947 | A1 | 12/2007 | Eksteen | |
| 2013/0029815 | A1 | 1/2013 | Lu | |
| 2017/0056708 | A1* | 3/2017 | Kelly | A63B 23/0233 |
| 2017/0100627 | A1 | 4/2017 | Monti | |
| 2018/0104528 | A1 | 4/2018 | McBride et al. | |

FOREIGN PATENT DOCUMENTS

| | | |
|---|---|---|
| CN | 106964109 | 7/2017 |
| KR | 10-1903711 | 10/2018 |
| WO | WO20190075071 | 4/2019 |

* cited by examiner

PUSHUP AND PLANKING EXERCISE DEVICE

RELATED APPLICATIONS

This application claims the benefit of priority under 35 U.S.C. 119(e) to U.S. Patent Application No. 63/321,492, entitled "Pushups and Planking Exercise Device," filed Mar. 18, 2022, which is hereby fully incorporated herein by reference for all purposes.

TECHNICAL FIELD

The present disclosure relates to devices that allow users to perform push-ups or planks.

BACKGROUND

Pushups and planks are common bodyweight exercises that are beneficial for building upper body strength because they work the triceps, pectoral muscles, and shoulders. Correct form is key to performing repetitive pushups without injury. Many people though lack the strength to perform pushups with proper form. Indeed, it is estimated that 93% of the population cannot do a regular pushup on their own. Therefore, what is desired are devices that assist users in performing pushups.

Planking refers to maintaining a straight, unbent/unarching body. There are many variations of planks, and planking may be performed with the arms anywhere from fully extended to fully bent. Many people though lack the strength to perform planks with proper form. Therefore, what is desired are devices that assist users in performing planks.

SUMMARY

Embodiments of the present disclosure provide devices for assisting users when performing exercises, such as planks and pushups. Embodiments further include methods of performing assisted exercises.

According to one aspect of the present disclosure, an apparatus for assisting pushups or planks is provided. The apparatus comprises a base structure having a substrate contact surface and a flat padded bench rotatably coupled to the base structure. The flat padded bench has a rectangular shape adapted to support the user and not interfere with the user's shoulders when performing a pushup or plank. The flat padded bench is rotatable relative to the base structure about an axis of rotation from a neutral or horizontal position to a first fully rotated position and a second fully rotated position. The height of the device may be selected to allow users to perform pushups with a natural range of motion. According to one embodiment, the top surface of the flat padded bench is six to fourteen inches from a substrate contact surface. As such, when the device is positioned on the floor, the top surface of the flat padded bench is six to fourteen inches from the floor when in a neutral position.

Aspects of the present disclosure may include one or more of the following features. The support structure has an adjustable height. The top surface is ten to twelve inches from the substrate contact surface when the bench is in the neutral position. The flat padded bench is sixteen to twenty four inches long and eight to fourteen inches wide. The flat padded bench is twenty to twenty four inches long. The flat padded bench is rotatable at least thirty-five degrees from the horizontal. The flat padded bench is rotatable at least forty-five degrees from the horizontal. The flat padded bench is rotatable about the axis of rotation in either direction a maximum of thirty degrees to fifty degrees. The base structure comprises a transverse support member that defines the axis of rotation. The flat padded bench has a lateral axis, where the axis of rotation is parallel to the lateral axis. The axis of rotation is in a vertical plane with the lateral axis when the flat padded bench is in a neutral position. The flat padded bench is coupled to the base structure by a revolute joint.

Other aspects include using exercise assistance devices herein to perform exercises. One embodiment of a method can include providing an apparatus formed according to the present disclosure, positioning a user's body on the apparatus to achieve a desired difficulty for an exercise, and performing the exercise with assistance from the apparatus. Methods may further include moving the user's body longitudinally relative to the apparatus to adjust the difficulty of the exercise. For some exercises, performing the exercise will cause the flat padded bench to rotate relative to the base structure. Examples of exercises include, but are not limited to, planks, pushups, balancing exercises, and accessory exercises. In some cases, the exercise may be performed during the recovery stage from an injury.

The device allows the user to adjust the difficulty of planks and pushups to by repositioning their body. For example, a user can position their body at an angle or with their feet further from the bench to decrease the required force. The force required to perform a pushup or a plank can be reduced to the point that even a user who cannot perform a plank or pushup by themselves can do so with the assistance of the device. Moreover, the ability of embodiments to reduce the force required to perform a plank or a pushup allows such embodiments to be used during an injury recovery phase that would otherwise prevent planks or pushups.

Further, by repositioning their body at angle and/or feet further from center of board, a user can use embodiments herein such that the user applies different forces to the left and right side individually to achieve the amount of force required for the given exercise. Thus, for example, a user can angle their body relative to the device to favor their left arm, shoulder, and chest or their right arm, shoulder, and chest during a pushup or plank.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

The invention and the various features and advantageous details thereof are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

Embodiments described herein provide devices that assist users in performing pushups or planks. More particularly, using a cantilever or teeter totter system, the user's weight may be dispensed according to the strength of the person. To increase the force needed for push-ups or planks, the person simply slides forward. Embodiments may also be used for balancing for people already able to do push-ups by placing a hand on either side of the board and doing balancing push-ups. Other uses would include use as a balancing board. In some embodiments, additional attachments can be added for additional assistance.

Embodiments provide an advantage by using a flat bench that avoids improper form and excessive back arching. Further embodiments are low to the ground while allowing the user to achieve the full range of motion. By being low to the ground, the pushup device helps avoid injuries possible from falling or sliding off of a taller device. Moreover, the angle of inclination/declination can be limited so as to avoid angles that would lead to increased cranial blood pressure contraindicated for diabetics, people with heart issues, and people with high blood pressure. Further, the user can remain in contact with and be supported by the device throughout their range of motion while performing an exercise.

Figure 1:
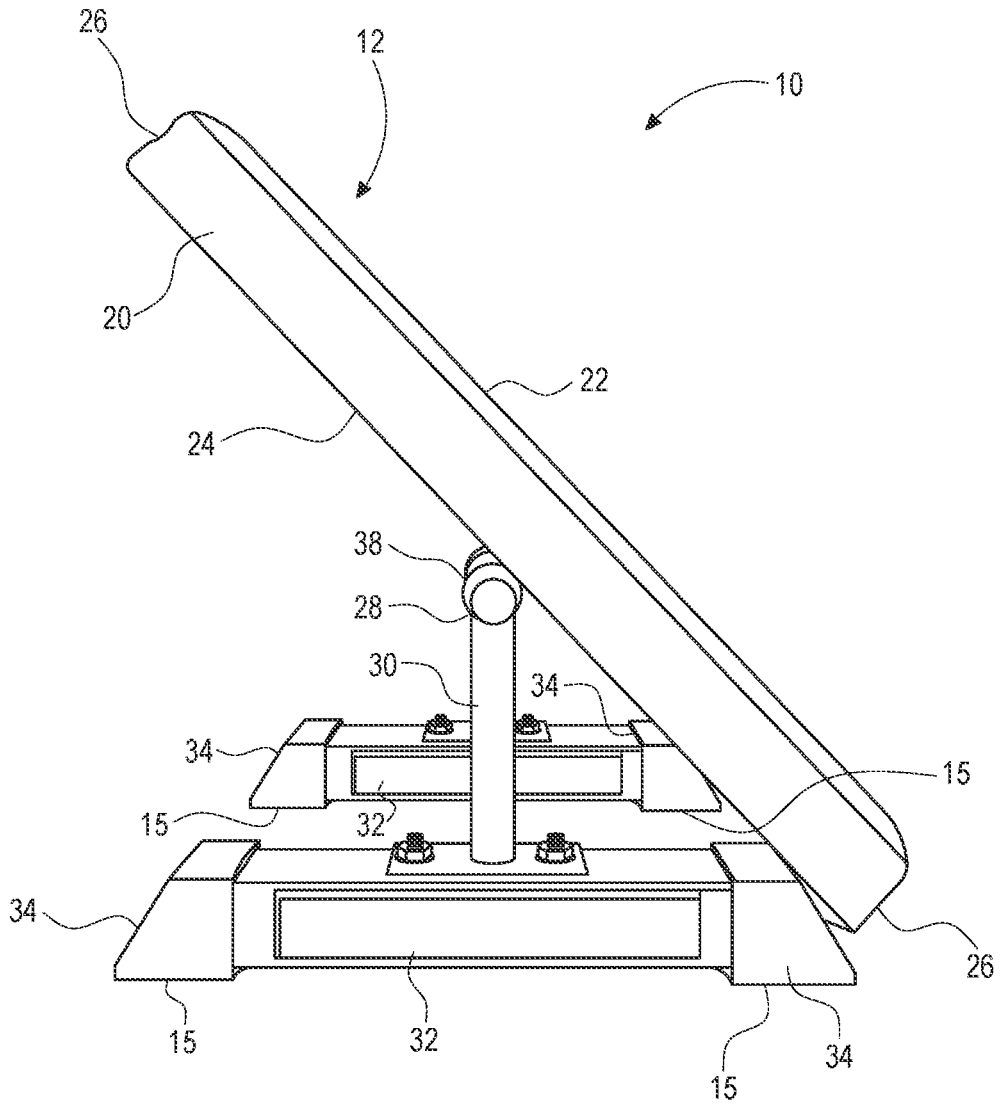
FIG. 1 depicts one embodiment of a pushup or planking assistance device.
Figure 2:
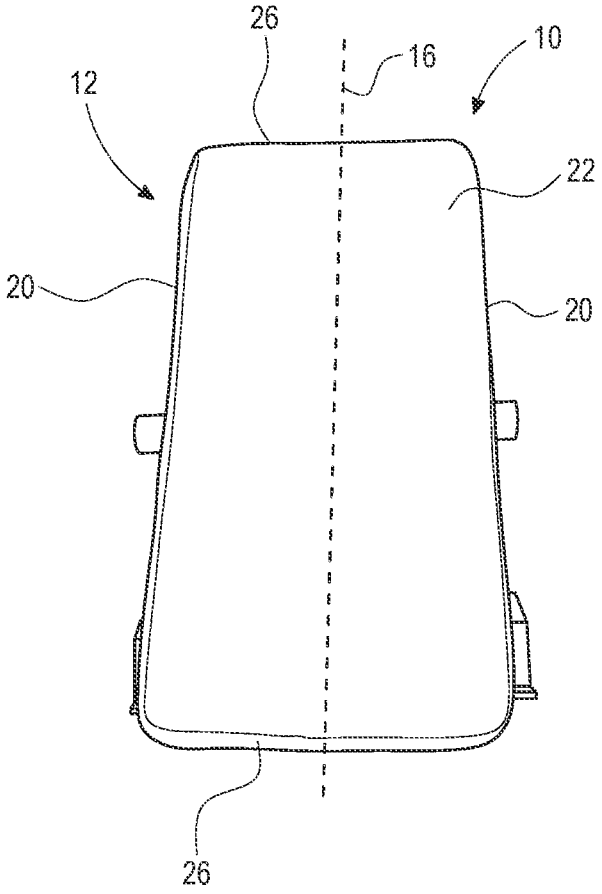
FIG. 2 depicts another view of the embodiment of FIG. 1.

FIG. 1 and FIG. 2 illustrate one example embodiment of a pushup/planking device 10. The pushup/planking device 10 comprises a padded bench 12 rotatably coupled to a base 14. Base 14 includes a bottom surface or other substrate contact surface 15 that contacts the substrate (e.g., floor) when device 10 is in use.

In the illustrated embodiment, the padded bench 12 has a rectangular shape with a longitudinal axis 16, a lateral axis perpendicular to the longitudinal axis, longitudinal sides 20, a top surface 22, a bottom surface 24, and transverse ends 26 that span laterally between the longitudinal sides. The rectangular shape may have rounded or sharp corners or combinations thereof. In use, the longitudinal axis 16 of the padded bench 12 generally aligns with the longitudinal axis of the user when the user is face down on the padded bench 12.

Padded bench 12 is rotatable about a horizontal axis of rotation that is parallel to the ground and perpendicular to the longitudinal axis 16. In even more particular embodiments, padded bench 12 is rotatable about an axis of rotation that is parallel to and in a vertical plane with the lateral axis of bench 12.

In the illustrated embodiment, the axis of rotation is closer to the padded bench 12 than to the floor. In other embodiments, the axis of rotation may be located elsewhere. By way of example, but not limitation, some implementations may use an A-Frame with stop/support in the middle or near the floor.

In any case, bench 12 may, for example, be rotatable clockwise from a neutral position in which top surface 22 is horizontal to a first fully rotated position in which the midline or other portion of padded bench 12 is rotated to a first side of the axis of rotation (e.g., to the front of the axis as illustrated in FIG. 1) and anti-clockwise from the neutral position to a second fully rotated position to a second side of the axis of rotation (e.g., wherein the midline or other portion of flat padded bench 12 is behind the axis of rotation). In some embodiments, the range of clockwise and anti-clockwise rotational motion from the neutral position is symmetrical. In other embodiments, flat padded bench may rotate further from the neutral position in one rotational direction than the other rotational direction about the axis of rotation.

Bench 12 may be formed with a material, such as plywood, metal, composite materials, plastic or other material or combinations thereof to provide a relatively stiff rectangular bench base portion, with one or more layers of padding, such as foam, cotton batting, or other padding or combinations thereof over the bench base portion, and a cover, such as fabric, leather, vinyl, or the like, over the padding.

Bench 12 may comprise, for example, a straight board of a metal, wood, plastic, composite material, or another material, or combinations thereof, covered on the top, sides, and ends with padding and vinyl upholstery material, leather, or other covering. The top side of the board, according to one embodiment, is flat along the length of the board, giving the top surface 22 of the padded bench 12 a flat profile. The longitudinal sides and transverse ends of the board may be straight. In other embodiments, the board may have other shapes, such as, but not limited to, shapes with curved longitudinal sides or transverse ends such that longitudinal sides 20 are curved along their lengths or the transverse ends 26 are curved along their widths.

Base 14 of device 10 comprises frame members formed from materials such as wood, plywood, steel, composite materials or plastic or combinations thereof. The frame members may include solid elements, hollow elements (e.g., tubing) or a combination thereof. Each frame member may be formed as a unitary part or comprise multiple pieces joined or otherwise coupled together to form the frame member. A portion of the base acts as a substrate contact surface 15 that is adapted to contact a substrate (e.g., floor) when the device is in use.

In the embodiment illustrated, the frame elements of FIGS. 1 and 2 include a transverse support member 28 that supports bench 12 and defines the axis of rotation for bench 12. During use, transverse support member 28 is, according to one embodiment, parallel to the floor or other substrate on which device 10 is placed. Transverse support member 28 is supported by two laterally spaced legs attached to transverse support member 28. Each leg comprises an upward support member 30 (only one is denoted as the second upward support member is obscured by the first leg in FIG. 1) that is coupled to a longitudinal support member 32. The upward support members 30 may be vertical (as illustrated), splayed inward, or splayed outward for a predetermined distance. The longitudinal support members 32 touch the floor or other substrate during use. In some embodiments, longitudinal support members are laterally spaced to be narrower than bench 12 with the ends positioned so that, when bench 12 is in a fully rotated position, bottom surface 24 of bench 12 contacts the ends of longitudinal support members 32 without the lower end portion of bench 12 touching the floor. In some embodiments, longitudinal support members 32 include end caps 34 formed of plastic, rubber, or other suitable materials with angled end faces such that bottom surface 24 of bench 12 rests against the angled end faces when bench 12 is fully rotated.

According to one embodiment, bench 12 is coupled to base 14 at a joint 38, which is a revolute joint or other rotatable joint that allows rotation of bench 12 about the axis of transverse support member 28. For example, bench 12 of FIG. 1 and FIG. 2 is coupled to transverse support member 28 by a collar (in this case a pair of collars) that can rotate around transverse support member 28. In some embodiments, joint 38 can include a bushing, bearings, or other mechanisms to reduce friction—for example, a bushing or bearings disposed between each collar and transverse support member 28.

In some embodiments, rotation of bench 12 is unrestrained other than by any friction of joint 38. Thus, bench 12 may be free to rotate to a fully rotated position under the force of gravity without any additional applied force. In other embodiments, resistive elements may be added to resist rotation. A torsional spring or other biasing device may be positioned between the padded bench 12 and the base 14 to provide additional assistance to the user to return to a neutral position.

Padded bench 12 can thus rotate clockwise or anti-clockwise until the movement of padded bench 12 is stopped by the base 14 or the floor. The length of the padded bench 12, the shape of the padded bench 12, the height of the padded bench, or the form factor of the base 14 can be selected so that the declination of the padded bench 12 will not exceed a desired maximum angle when in use. In other embodiments, stops or other mechanisms, may be used such that the inclination/declination of the padded bench 12 will not exceed the desired maximum angle. In some embodiments, padded bench 12 can rotate a maximum of plus or minus 35-50 degrees from the horizontal (70 to 100 degrees total). In even more particular embodiments, padded bench 12 can rotate a maximum of approximately plus or minus 45 degrees from the horizontal. In yet other embodiments, padded bench 12 can rotate at least plus or minus 45 degrees from the horizontal.

Bench 12 is shaped and sized to provide support to the user while still requiring the user to engage their core when performing a pushup or plank. Further, the user's shoulders are not restricted, which reduces the likelihood that the user will arch their back during the pushup. Preferably, the padded bench 12 is 16-24 inches long (length being parallel to longitudinal axis 16), and even more preferably 20-24 inches long, and 8 to 14 inches wide (width being transverse to longitudinal axis 16). Even more preferably, the padded bench 12 is 16-24 inches long and 12 inches wide. A length of 16-24 inches is long enough to provide adequate support to the user, but still requires the user to engage their core, whereas longer benches do not require engaging the core. However, other embodiments may have other shapes.

According to one embodiment, device 10 is 14 inches or less tall and, in more particular embodiments, 12 inches or less tall when in the neutral position. As will be appreciated, the muscle group targeted by an exercise can depend on the height of bench 12. It has been determined that having the top surface 22 of bench 12 below 12 inches more accurately simulates natural body position for a push-up and plank. In some embodiments then, device 10 is 8-12 inches tall—that is, when in the neutral position, the top surface 22 of bench 12 is 6-12 inches from the substrate contact surface 15 of base 14 and hence the floor or other substrate). Even more particularly, the top surface is 10-12 inches from the floor (for example 11 inches tall) in some embodiments, though other embodiments can have other heights. Further, in some embodiments, the height of base 14 is adjustable to raise or lower bench 12, for example to position the top surface of bench 12 at a height from 6-14 inches or any sub-range therein, but preferably able to achieve a height of at least 11 inches. In one such embodiment, upward support members 30 may be for example telescoping members.

Figure 3:
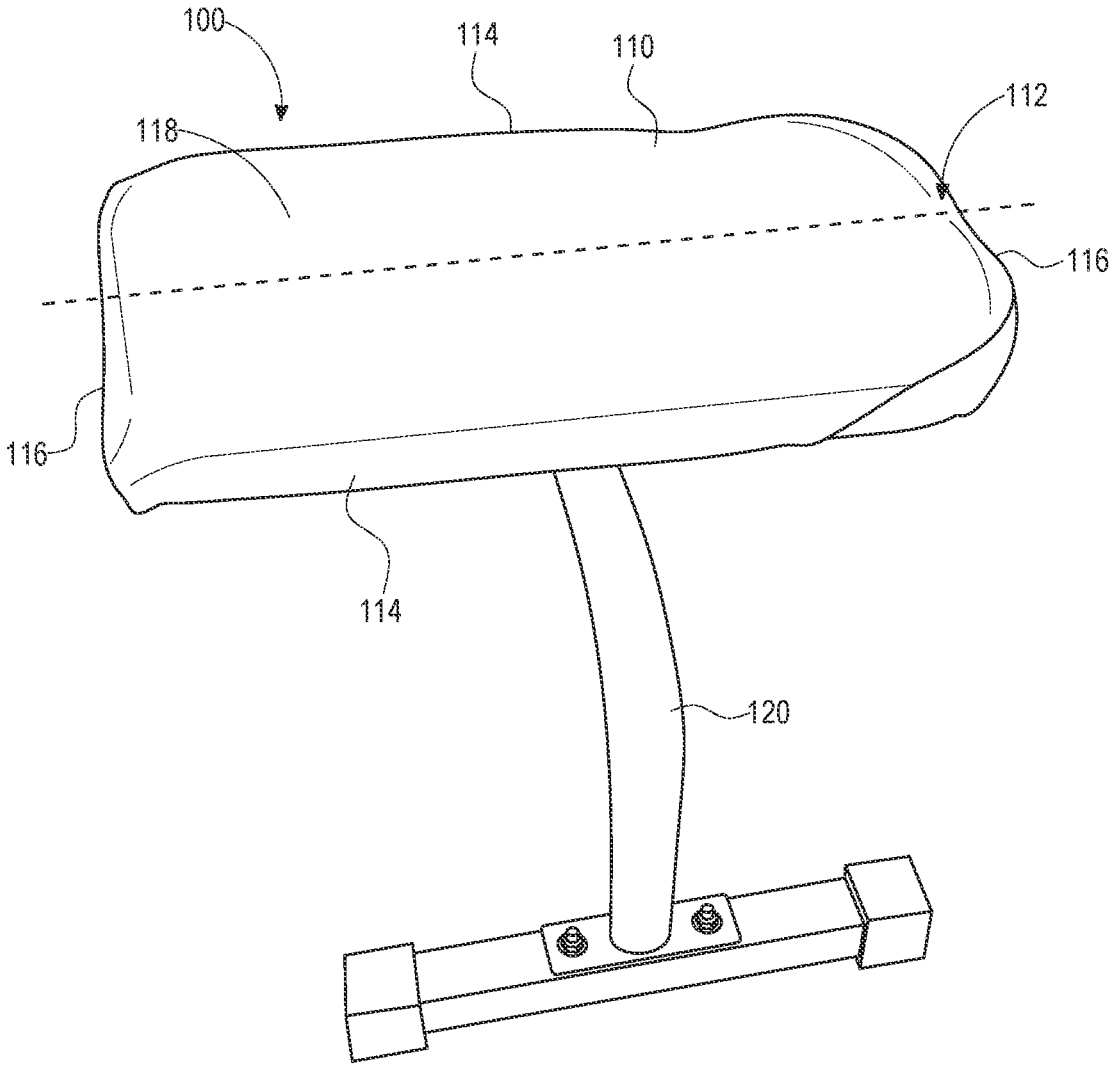
FIG. 3 depicts a second embodiment of a pushup or planking assistance device.
Figure 4:
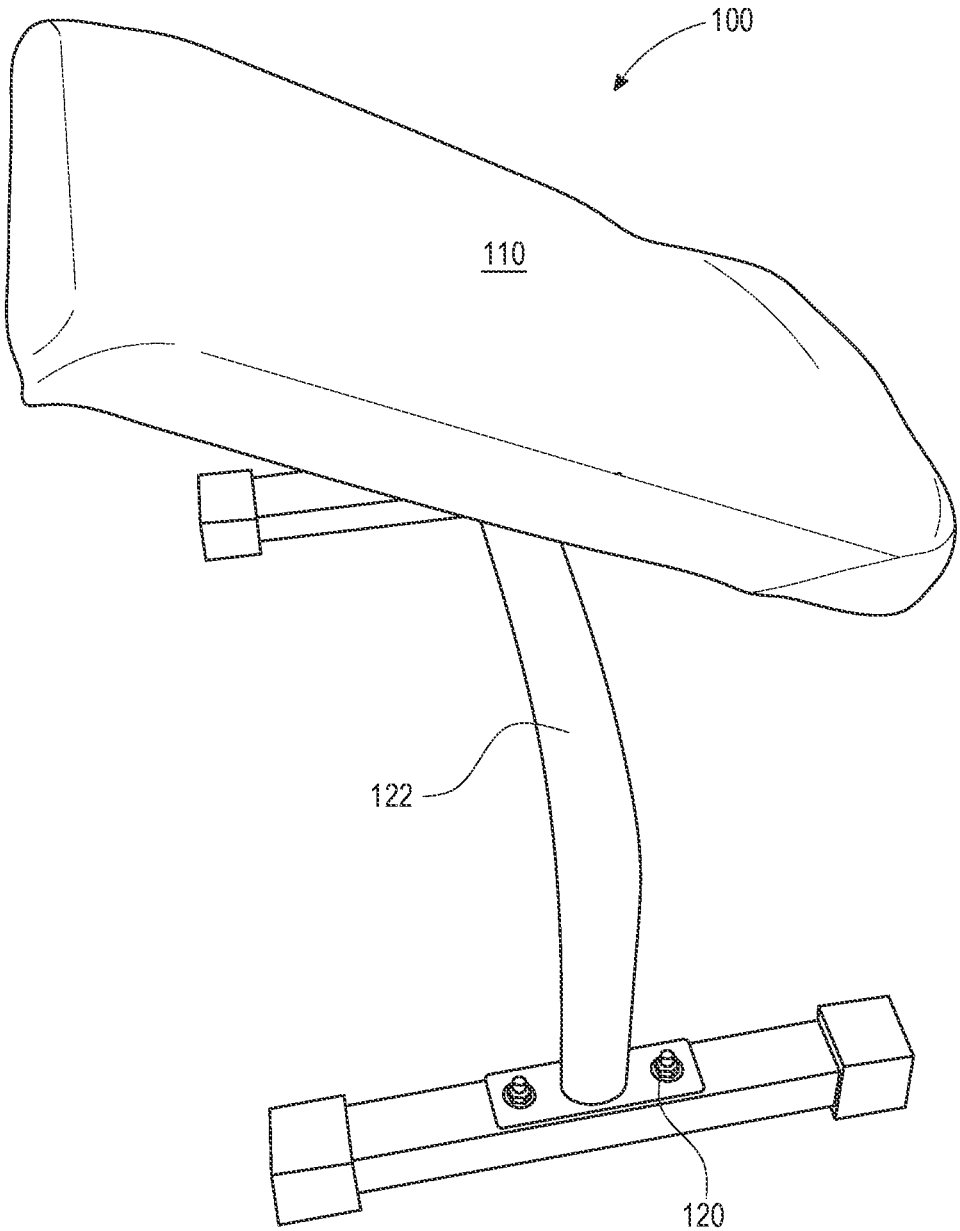
FIG. 4 depicts a second view of the embodiment of FIG. 3.

FIG. 3 and FIG. 4 illustrate another example embodiment of a pushup/planking device 100. The pushup/planking device 100 comprises a padded bench 110 rotatably coupled to a base 120. Base 120 includes a bottom surface or other substrate contact surface that contacts the substrate (e.g., floor) when device 100 is in use.

In the illustrated embodiment, the padded bench 110 has a rectangular shape with a longitudinal axis 112, longitudinal sides 114, and transverse ends 116. The rectangular shape may have rounded or sharp corners or combinations thereof. In the illustrated embodiment, padded bench 110 is a flat bench. According to one embodiment, the padded bench is rotatable at its midline relative to base 120 about a horizontal axis of rotation that is perpendicular to the longitudinal axis 112 (the longitudinal axis 112 of the padded bench 110 generally aligns with the longitudinal axis of the user when the user is face down on the padded bench 110). For example, base 120 includes a transverse support member 122 that provides an axis of rotation about which bench 110 can rotate.

According to one embodiment, rotation of the padded bench 110 is unrestrained other than by any friction of the joint. The padded bench 110 can thus rotate clockwise or anti-clockwise until the movement of padded bench 110 is stopped by the base 120 or the floor. The length of the padded bench 110, the shape of the padded bench 110, the height of the padded bench, or the form factor of the base 120 can be selected so that the declination of the padded bench 110 will not exceed a desired maximum angle when in use. In other embodiments, stops or other mechanisms, may be used such that the inclination/declination of the padded bench 110 will not exceed the desired maximum angle. In some embodiments, padded bench 110 can rotate a maximum of plus or minus 35-50 degrees from the horizontal. In even more particular embodiments, padded bench 110 can rotate a maximum of approximately plus or minus 45 degrees from the horizontal. In yet other embodiments, padded bench 110 can rotate at least plus or minus 45 degrees from the horizontal. According to one embodiment, the padded bench 110 can rotate up to 270 degrees. Because increased cranial blood pressure is contraindicated for diabetics, people with heart issues, and people with high blood pressure can be avoided for embodiments that can achieve a high inclination/declination.

According to one embodiment, the axis of rotation is closer to the padded bench 110 than to the floor. In other embodiments, the axis of rotation may be located elsewhere. By way of example, but not limitation, some implementations may use an A-Frame with stop/support in the middle or near the floor.

The padded bench 110 may comprise, for example, a board of a metal, wood, plastic, composite material, or another material, or combinations thereof, covered on the top, sides, and ends with padding and vinyl upholstery material, leather, or other covering. The top side of the board, according to one embodiment, is flat along the length of the board, giving the top side 118 of the padded bench 110 a flat profile. The longitudinal sides and transverse ends of the board may be straight. In other embodiments, the board may have other shapes, such as, but not limited to, shapes with curved longitudinal sides or transverse ends such that longitudinal sides 114 are curved along their lengths or the transverse ends 116 are curved along their widths.

The padded bench is shaped and sized to provide support to the user while still requiring the user to engage their core when performing a pushup or plank. Further, the user's shoulders are not restricted, which reduces the likelihood that the user will arch their back during the pushup. Preferably, the padded bench 110 is 20-24 inches long (length being parallel to longitudinal axis 112) and 8 to 14 inches wide (width being transverse to longitudinal axis 112). Even more preferably, the padded bench 110 is typically 16-24 inches long and 12 inches wide. A length of 16-24 inches is long enough to provide adequate support to the user, but still requires the user to engage their core, whereas longer benches do not require engaging the core. However, other embodiments may have other shapes. Moreover, the maximum height of the top side of padded bench 110, according to one embodiment, is 6-14 inches. That is, the top surface of bench 110 is 6-12 inches from the substrate contacting portion of base 120 and hence the floor or other substrate when in the neutral position. In even more particular embodiments, the height is 10-12 inches and, in an even more particular embodiment, 11 inches.

The base 120 may have a variety of form factors and can be slightly narrower than the padded bench 110, equal to the padded bench or wider than the padded bench 110. In some embodiments, a torsional spring or other biasing device may be positioned between the padded bench 110 and the base 120 to provide additional assistance to the user to return to a raised position.

Figure 5:
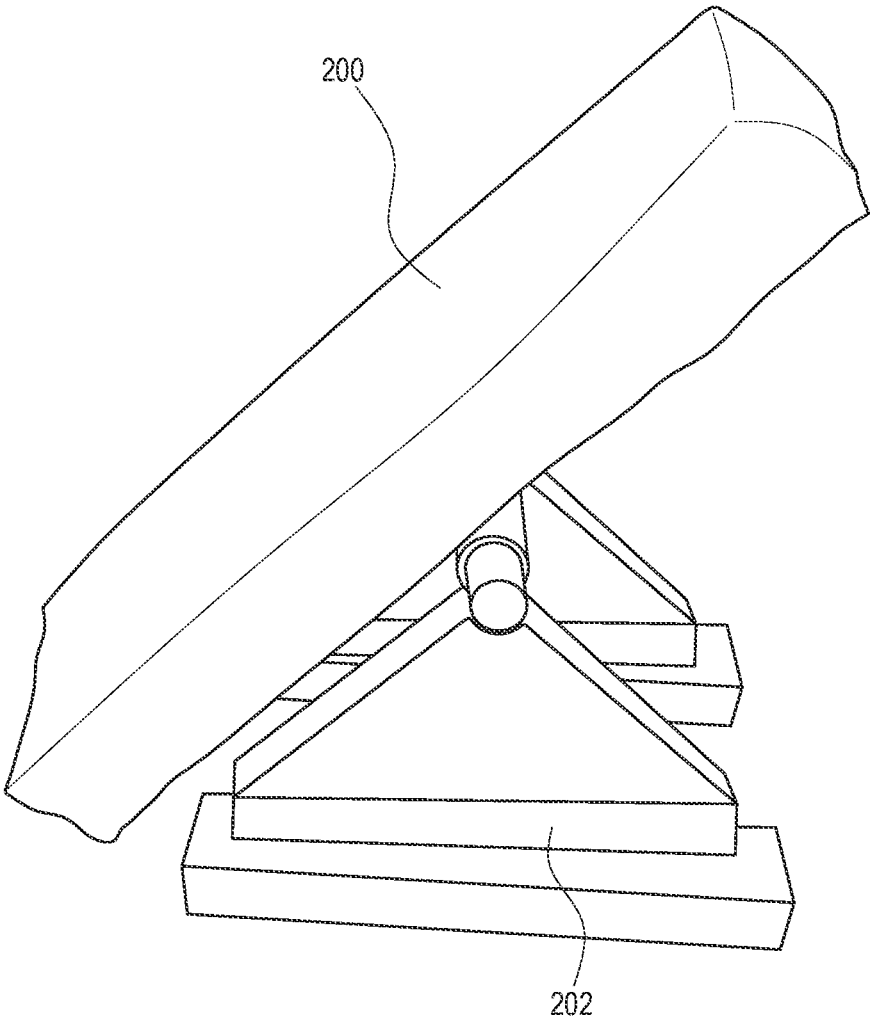
FIG. 5 depicts another embodiment of a pushup or planking assistance device.

FIG. 5 illustrates another example of a device having a flat padded bench 200 rotatably coupled to a base 202 with triangular upward support members. The size, height, and degree of rotation of the padded bench about the transverse member may be selected as discussed above.

As will be appreciated, pushup/planking devices described herein may be used to perform a variety of exercises, such as pushups, forearm planks, straight arm planks, side planks, or other planks in which the user's weight is borne by the user's hands or arms and the portion of the user's body supported by the device.

Figure 6A:
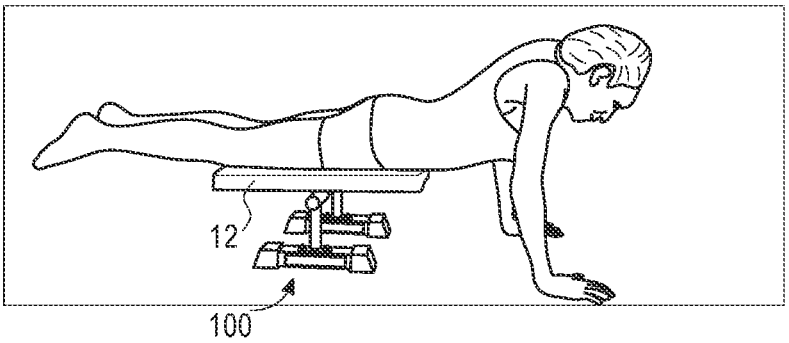
FIG. 6A-FIG. 6C depicts a user using one embodiment of a pushup or planking device to perform an exercise and FIG. 6D illustrates one embodiment of the user adjusting the difficulty of the exercise.
Figure 6B:
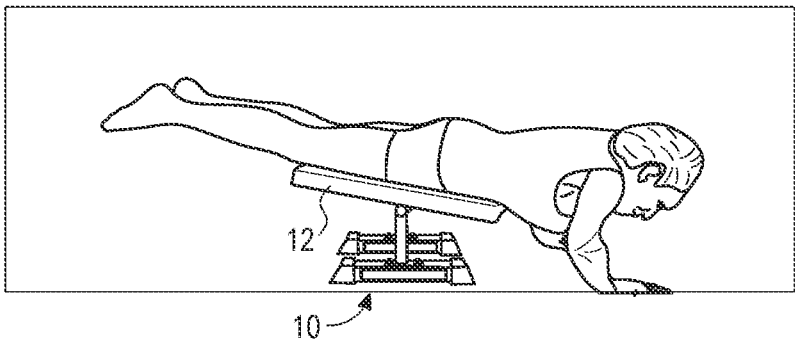
Figure 6C:
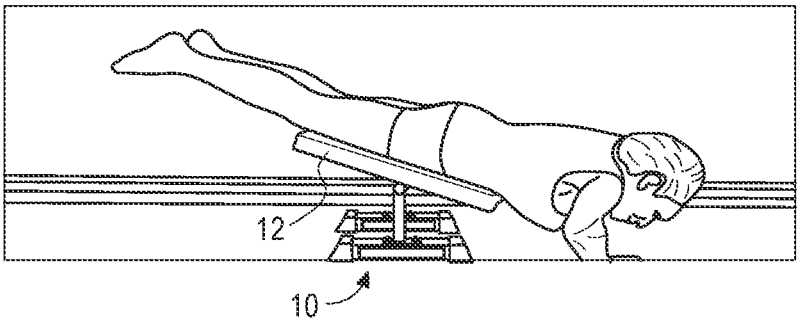
Figure 6D:
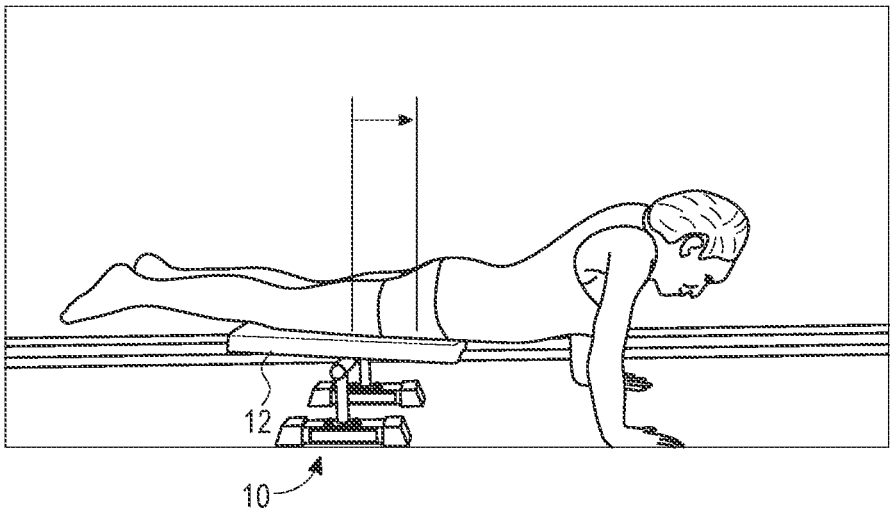

FIG. 6A, FIG. 6B, and FIG. 6C, for example, illustrate a user performing a pushup using device 10. To do a pushup, for example, the user approaches the pushup/plank device from a crouched position and brings themself forward into the desired position for the top of the pushup, with a portion of their body resting on bench 12 and their hands on the floor. The user can then lower themselves and push themselves back up in a pushup motion. The user can increase the difficulty of performing pushups using device 10 simply by moving their upper body further from the center of bench 12 as illustrated in FIG. 6D. Moreover, the user may angle their body relative to bench 12 to favor a particular side of their body while doing a pushup or holding a plank.

Figure 7:
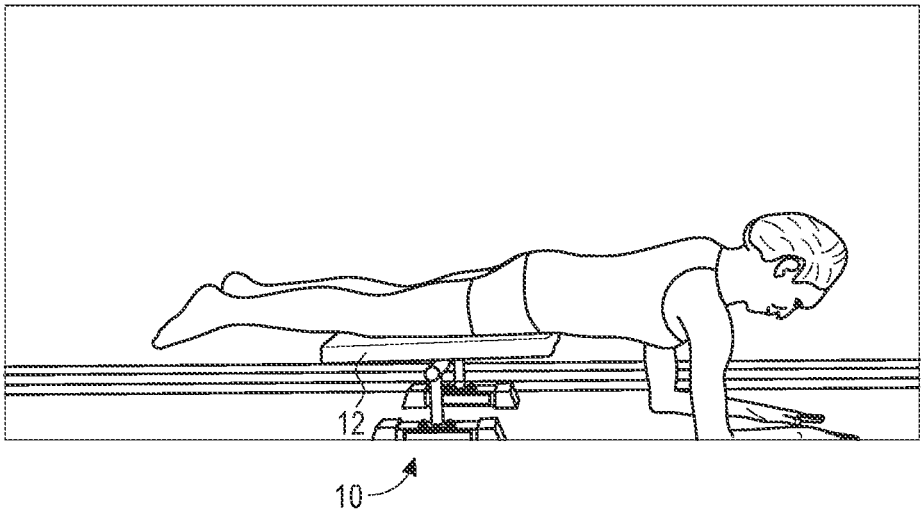
FIG. 7 depicts a user using one embodiment of a pushup or planking device to perform another exercise.

FIG. 7 illustrates one embodiment of a user performing a plank using device 10. To do a front plank, for example the user approaches the pushup/plank device from a crouched position and brings themself forward into the desired front plank position on the padded bench with their hands or arms to the floor. For example, the user can bring themselves forward with their body supported by device 10 and their forearms to the floor. The user can adjust the difficulty of the plank by adjusting their position on the bench (e.g., by sliding forward to increase difficulty and sliding back to decrease the difficulty of the plank).

Devices according to the present disclosure may also be used as a balance board for performing a variety of balance exercises, such as exercises with the user sitting on the bench 12, 110, 200 with one leg on either side of the lateral axis (or axis of rotation) or otherwise positioned on bench 12, 110, 200 in a manner that requires a user to balance. As another example, a user may perform a push up or hold a plank with their hands/forearms on bench 12, 110, 200 to either side of the axis of rotation. Yoga blocks or the like can be used to limit rotation of bench 12, 110, 200 during balance or other exercises. Devices according to the present disclosure can be used to support accessory exercises, such as ab rollouts using a wheel or exercise ball.

It should be noted that any dimensions, ranges of motion, or the like are provided by way of example and not limitation, and embodiments according to the present disclosure include embodiments having other dimensions, sizes, or ranges of motion. Moreover, it should be understood that the various ranges described include all intermediate embodiments.

While embodiments described herein have generally been depicted as standalone devices, some embodiments can integrate a pushup/planking apparatus in a multifunction station. For example, in some embodiments, transverse support member 28 is provided by a frame member near the base of a power tower or other exercise apparatus. In other words, a flat padded bench may be rotatable coupled to a horizontal bar or other frame member at or near the base of a power tower or other exercise apparatus to provide a pushup or planking device.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the invention.

What is claimed is:

1. An apparatus for assisting pushups or planks:

a base structure having a substrate contact surface for contacting a substrate, the base structure comprising:
- a pair of legs; and
- a transverse member extending between the pair of legs, the transverse member defining an axis of rotation, wherein the pair of legs are adapted to support the transverse member;

a flat padded bench having a rectangular shape with a length and width to support a front portion of a user's body, wherein the length is greater than the width and wherein the flat padded bench comprises:
- a top surface;
- a bottom surface;
- longitudinal sides; and
- transverse ends; and a joint, wherein the flat padded bench is rotatably coupled to the transverse member at the joint, wherein the flat padded bench is rotatable relative the base structure about the axis of rotation from a neutral position to a first fully rotated position and a second fully rotated position, wherein the top surface is six to fourteen inches from the substrate contact surface when in the neutral position, wherein the flat padded bench is adapted to rotate about the axis of rotation during use as a user performs an exercise, and wherein the transverse member extends transversely to the length of the flat padded bench.

2. The apparatus of claim 1, wherein the flat padded bench is sixteen to twenty four inches long and eight to fourteen inches wide.

3. The apparatus of claim 2, wherein the flat padded bench is twenty to twenty four inches long.

4. The apparatus of claim 1, wherein in the base structure has an adjustable height.

5. The apparatus of claim 1, wherein the top surface is ten to twelve inches from the substrate contact surface when in the neutral position.

6. The apparatus of claim 1, wherein the flat padded bench is rotatable at least thirty five degrees from a horizontal plane.

7. The apparatus of claim 1, wherein the flat padded bench is rotatable at least forty five degrees from a horizontal plane.

8. The apparatus of claim 1, wherein the flat padded bench is rotatable about the axis of rotation either direction a maximum of thirty degrees to fifty degrees.

9. The apparatus of claim 1, wherein the flat padded bench has a lateral axis and wherein the axis of rotation is parallel to and in a vertical plane with the lateral axis when the flat padded bench is in the neutral position.

10. The apparatus of claim 1, wherein the flat padded bench is coupled to the base structure by a revolute joint.

11. The apparatus of claim 1, wherein the transverse member extends transversely past the longitudinal sides.

12. The apparatus of claim 1, wherein the base structure comprises a longitudinal support member that extends longitudinally to a first side of the transverse member and to a second side of the transverse member, wherein the longitudinal support member comprises the substrate contact surface, wherein at least one of clockwise rotation or anti-clockwise rotation of the flat padded bench about the axis of rotation is limited by the longitudinal support member, and wherein in the first fully rotated position the bottom surface of the flat padded bench contacts the longitudinal support member.

13. The apparatus of claim 1, wherein the base structure comprises a longitudinal support member that extends longitudinally to a first side of the transverse member and to a second side of the transverse member, wherein the longitudinal support member comprises the substrate contact surface and wherein the flat padded bench is a adapted to rotate about the axis of rotation at least one of clockwise or anti-clockwise to contact the substrate.

14. An exercise method comprising:

providing an apparatus comprising:

a base structure having a substrate contact surface for contacting a substrate, the base structure comprising:
- a pair of legs; and
- a transverse member extending between the pair of legs, the transverse member defining an axis of rotation, wherein the pair of legs are adapted to support the transverse member;

a flat padded bench rotatably coupled to the base structure and having a rectangular shape with a length and width to support a front portion of a user's body, wherein the length is greater than the width and wherein the flat padded bench comprises:
- a top surface;
- a bottom surface;
- longitudinal sides; and
- transverse ends; and a joint, wherein the flat padded bench coupled to the transverse member at the joint, wherein the flat padded bench is rotatable relative the base structure about the axis of rotation from a neutral position to a first fully rotated position and a second fully rotated position, and wherein the top surface is six to fourteen inches from the substrate contact surface when in the neutral position;

positioning a user's body on the apparatus to achieve a desired difficulty for an exercise; and performing the exercise with assistance from the apparatus.

15. The method of claim 14, wherein the flat padded bench is sixteen to twenty four inches long and eight to fourteen inches wide.

16. The method of claim 15, wherein the flat padded bench is twenty to twenty four inches long.

17. The method of claim 14, wherein the exercise is a pushup or a plank.

18. The method of claim 14, further comprising moving the user's body longitudinally relative to the apparatus to adjust the difficulty of the exercise.

19. The method of claim 14, wherein performing the exercise causes the flat padded bench to rotate relative to the base structure.

20. The method of claim 14, wherein the exercise is an accessory exercise.

21. The method of claim 14, wherein the exercise is performed during a recovery stage of an injury.

22. The method of claim 14, wherein the top surface is ten to twelve inches from the substrate contact surface when in the neutral position.

* * * * *